US006196325B1

(12) United States Patent
Connell et al.

(10) Patent No.: US 6,196,325 B1
(45) Date of Patent: Mar. 6, 2001

(54) HEAVY-DUTY LOGGING AND PERFORATING CABLEHEAD FOR COILED TUBING AND METHOD FOR RELEASING WIRELINE TOOL

(75) Inventors: Michael L. Connell; Robert G. Howard, both of Duncan; James C. Tucker, Springer, all of OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/205,967

(22) Filed: Dec. 4, 1998

(51) Int. Cl.[7] ..... E21B 19/00; E21B 23/00

(52) U.S. Cl. ..... 166/377; 166/65.1; 166/242.6; 166/384; 166/385

(58) Field of Search ..... 166/377, 384, 166/385, 65.1, 77.2, 242.6, 242.7

(56) References Cited

U.S. PATENT DOCUMENTS

| | | | | |
|---|---|---|---|---|
| 2,971,178 | | 2/1961 | Reesby | 339/7 |
| 4,279,304 | * | 7/1981 | Harper | 166/307 X |
| 4,624,308 | | 11/1986 | White | 166/65.1 |
| 4,874,327 | | 10/1989 | Ip | 439/275 |
| 4,928,764 | | 5/1990 | Roessler | 166/250 |
| 4,997,041 | * | 3/1991 | Petree | 166/377 |
| 5,043,949 | | 8/1991 | Shechter | 367/76 |
| 5,109,921 | | 5/1992 | Aracena | 166/65.1 |
| 5,323,853 | * | 6/1994 | Leismer et al. | 166/377 X |
| 5,398,753 | * | 3/1995 | Obrejanu et al. | 166/66.4 X |
| 5,477,921 | * | 12/1995 | Tollefsen | 166/65.1 X |
| 5,505,261 | * | 4/1996 | Huber et al. | 166/297 |
| 5,580,114 | * | 12/1996 | Palmer | 294/86.15 |
| 5,947,198 | * | 9/1999 | McKee et al. | 166/377 X |
| 6,032,733 | * | 3/2000 | Ludwig et al. | 166/65.1 X |

* cited by examiner

*Primary Examiner*—Eileen D. Lillis
*Assistant Examiner*—Jong-Suk Lee
(74) *Attorney, Agent, or Firm*—Robert A. Kent; Neal R. Kennedy

(57) ABSTRACT

A heavy-duty logging and perforating cablehead for coiled tubing. The cablehead includes an upper and lower housing which are shearably connected by shear pins. An actuating piston is slidably disposed in the housing. When the piston is in a running position, the piston holds a lug in locking engagement with the upper and lower housings such that the shear pins cannot be sheared. When the piston is moved to a releasing position, the lugs are released so that the upper and lower housings may be separated, thereby shearing the shear pins. Actuation of the piston is accomplished by pumping fluid down the coiled tubing and through a flow path in the cablehead and by applying pressure to the piston.

31 Claims, 8 Drawing Sheets

HEAVY-DUTY LOGGING AND PERFORATING CABLEHEAD FOR COILED TUBING AND METHOD FOR RELEASING WIRELINE TOOL

BACKGROUND OF THE INVENTION

1. Field of the Invention

This invention relates to cableheads for coiled tubing logging operations, the cableheads having mechanical devices for releasing a stuck tool, and more particularly, to a cablehead which allows releasing of a tool when desired while preventing accidental and premature release of the tool.

2. Description of the Prior Art

In heavy-duty logging and/or perforating operations, the logging tool and/or perforating guns may be run into the well using coiled tubing electric line reels. This technique is used particularly often on deviated or horizontal wells. Typically, a cablehead is positioned between the end of the length of coiled tubing and the logging tool and/or perforating guns. The cablehead has a means for mechanically connecting the tubing to the tool or guns and also for providing an electrical connection between a logging cable run down the inside of the coiled tubing and the logging tool or perforating guns. Many of these cableheads also include a means for releasing the tool or guns in the event that the tool or guns becomes stuck in the well.

Prior to the present invention, most cableheads for coiled tubing logging operations have relied on mechanical disconnects to provide a means of releasing in the event of a stuck tool situation. With such a mechanical disconnect, the coiled tubing is generally released from the stuck tool or gun by applying a predetermined amount of tension on the coiled tubing, thereby breaking a set of shear pins in the cablehead. Once the shear pins are broken, the coiled tubing is removed from the well, and the stuck tool or perforating gun may be fished out on a subsequent trip into the well.

A problem with the prior art mechanical disconnect portion of these cableheads is that there is a tendency to accidentally shear during perforating operations. When the guns are shot in wells that are substantially horizontal, this is not much of a problem because the vertical, or axial, shock loading is substantially negligible. However, when a well is deviated at a shallower angle, for example 60°, a substantial vertical shock load component is created when the guns are fired. Often, this vertical shock load is enough to prematurely shear the shear pins in the cablehead. Obviously when this happens, the guns are released and left in the well unintentionally.

Another problem with the mechanical disconnect portion of these prior art cableheads is that there are limitations when the shear load for shearing the pins is selected. The natural tendency of a tool operator is to select shear pins with strengths that are very high in order to prevent accidentally releasing the tool or perforating guns when in the well. However, the tensile strength of the coiled tubing is also a factor which must be considered when making the shear pin selection. For example, in a deep well, the weight of the coiled tubing string hanging in the well may be so high that the available over-pull at the surface is limited to a few thousand pounds. If the operator pulls on the tubing string at a higher load than this, there is the risk of parting the tubing at the surface, thereby leaving the entire tubing string and tool in the well which, of course, is a very undesirable situation.

The present invention solves this problem by providing a locking means such as a set of lugs to securely lock the components of the cablehead together so that no loading is prematurely applied to the shear pins. The shear pins may only be sheared after fluid is pumped down the coiled tubing and pressure applied to actuate a piston in the cablehead to release the lugs so that a shearing force may then be applied to the shear pins. Thus, there can be no premature shearing as in prior art mechanical disconnects.

SUMMARY OF THE INVENTION

The present invention is a cablehead for use with coiled tubing electric line in well operations. The cablehead comprises a housing and an actuating piston slidably disposed in the housing. The housing comprises an upper housing adapted for connection to a length of coiled tubing, a lower housing adjacent to the upper housing, and a shearing means for shearably attaching the lower housing to the upper housing. The cablehead further comprises a locking means, disposed between the upper and lower housings, for preventing shearing of the shearing means when the locking means is in a locked position and allowing shearing of the shearing means by relative movement between the upper and lower housing when the locking means is in an unlocked position. The piston has a running position holding the locking means in the locked position and is movable to a releasing position allowing movement of the locking means to the unlocked position.

The cablehead further comprises biasing means in the housing for biasing the piston toward the running position thereof. In the preferred embodiment, the biasing means is characterized by a compression spring.

The housing and piston define a first flow path therein through which fluid may be circulated when the piston is in the running position. A nozzle is disposed across the first flow path for controlling a fluid flow rate therethrough. This nozzle is one of a plurality of interchangeable nozzles which may have various sizes of orifices or ports therein. This first flow path is closed when the piston is in the releasing position.

The housing also defines a second flow path therethrough whereby fluid may be circulated when the piston is in the releasing position.

The piston has a saddle thereon which is aligned with the locking means when the piston is in the releasing position thereof so that the releasing means may be moved inwardly into the saddle. The piston comprises an upper piston on which the saddle is located and a prop attached to the upper piston.

The apparatus may also comprise a spring rest disposed in the housing and a second shearing means for shearably attaching the spring rest to the housing. This second shearing means is sheared when the piston is moved to the releasing position thereof. In the preferred embodiment, the spring is engaged with the piston and spring rest and disposed therebetween.

The upper housing defines a recess therein, and the lower housing defines a lug window therein aligned with the recess. The locking means is characterized, in the preferred embodiment, by a lug disposed in the window and extending into the recess when in the locked position and spaced from the recess when in the unlocked position. The lug extends into the saddle on the piston when the lug is in the unlocked position.

The present invention also includes a method of releasing a wireline tool in a well. This method comprises the step of providing a cablehead for connecting the wireline tool to a length of coiled tubing. This cablehead may be said to generally comprise a housing having an upper housing connectable to the coiled tubing and a lower housing shearably attached to the upper housing and connectable to the wireline tool, a lug disposed in the housing for preventing shearing disconnection of the upper and lower housings when the lug is in a locked position and allowing shearing disconnection of the upper and lower housings when the lug is in an unlocked position, and a piston disposed in the housing and movable between a running position holding the lug in the locked position and a releasing position allowing the lug to be moved to the unlocked position.

The method further comprises the steps of running the coiled tubing, cablehead and wireline tool into the wellbore with the piston in the running position thereof, pumping fluid down the coiled tubing and applying pressure to the piston and thereby moving the piston to the releasing position, applying tension to the coiled tubing such that the lug is moved to the unlocked position substantially simultaneously with the upper housing being shearably disconnected from the lower housing, and removing the coiled tubing and the upper housing from the wellbore. The method may further comprise the step of fishing the lower housing and the wireline tool from the wellbore. A fishing tool is engaged with a fishing neck defined in the lower housing when the upper housing has been disconnected from the lower housing.

In the method, the cablehead may further comprise a spring rest shearably connected to the housing, and a spring disposed between the spring rest for biasing the piston toward the running position. The step of pumping fluid down the coiled tubing and applying pressure to the piston may comprise pumping fluid through the coiled tubing and cablehead at a volume sufficient to move the piston from the running position thereof to a sealing position in which the piston engages the spring seat, and when the piston is in the sealing position, applying pressure thereto which thereby shearably releases the spring rest from the housing and moves the piston to the releasing position.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1A:
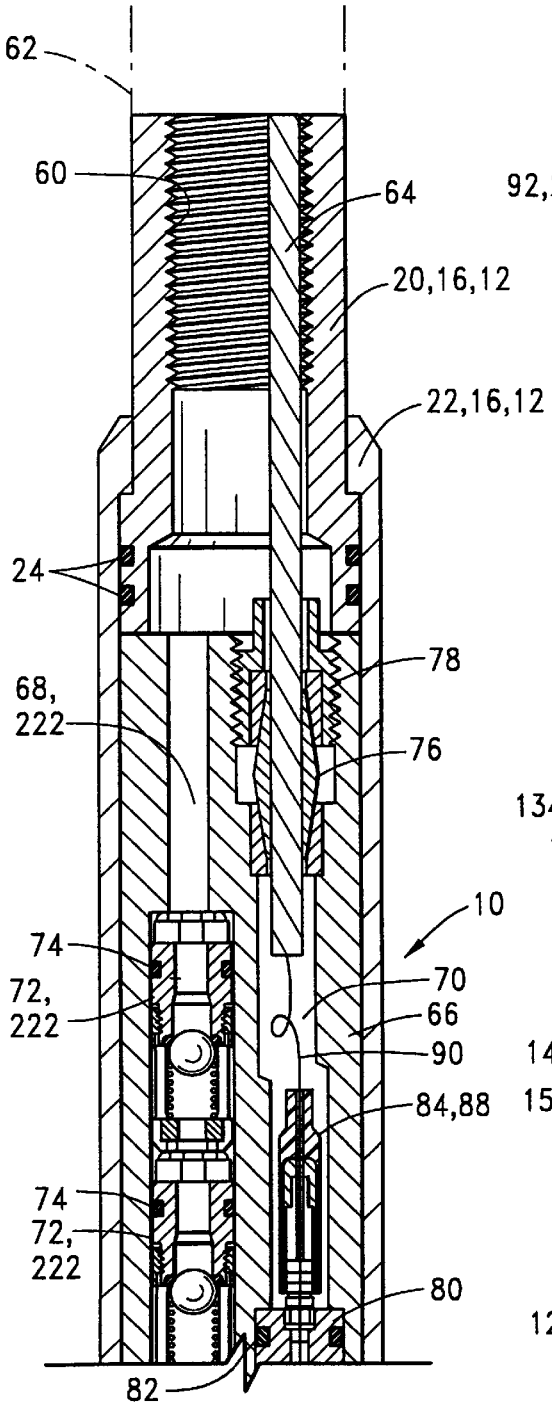
FIGS. 1A–1D show the heavy-duty logging and perforating cablehead for coiled tubing of the present invention with an actuating piston in a running position with lugs in a locked position for running a logging tool and/or set of perforating guns into a well on a length of coiled tubing.

Referring now to the drawings, and more particularly to FIGS. 1A–1D, the heavy-duty logging and perforating cablehead for coiled tubing of the present invention is shown and generally designated by the numeral 10. Generally, cablehead 10 comprises an outer housing 12 with an actuating piston 14 slidably disposed therein.

Housing 12 comprises an upper housing 16 and a lower housing 18. Upper housing 16 and lower housing 18 each are formed by a number of components.

Referring now to FIG. 1A, at the upper end of upper housing 16 is a top adapter 20 disposed in the upper end of a quick-connect collar 22. A sealing means, such as a pair of O-rings 24, provides sealing engagement between top adapter 20 and collar 22.

Figure 1B:
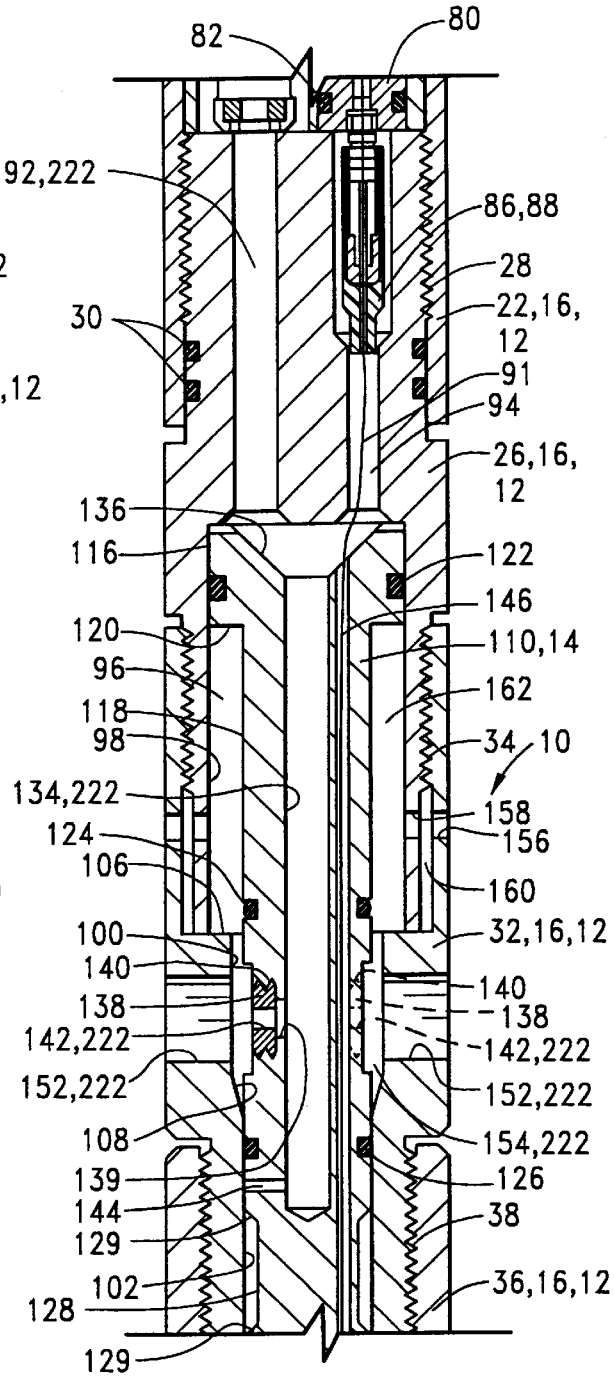

Referring to FIG. 1B, a piston sub 26 is attached to the lower end of collar 22 at threaded connection 28. A sealing means, such as a pair of O-rings 30, provides sealing engagement between piston sub 26 and collar 22.

The lower end of piston sub 26 is attached to a ported sub 32 at threaded connection 34.

Figure 1C:
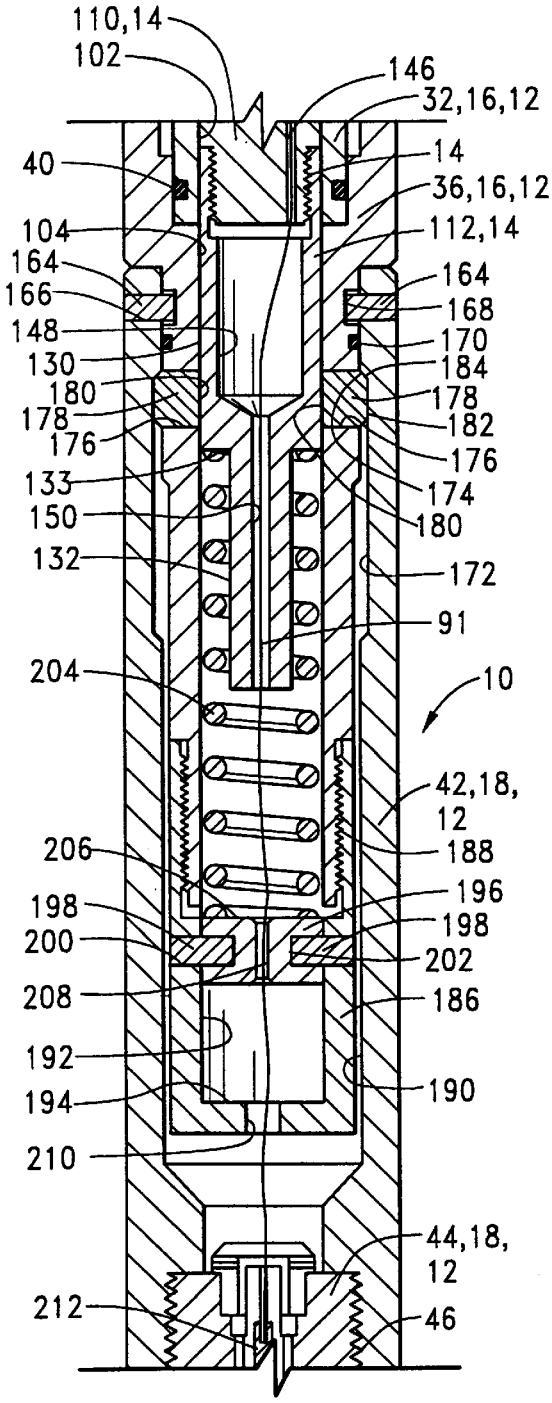

The lower end of ported sub 32 is attached to a lug window sub 36 at threaded connection 38. A sealing means, such as an O-ring 40, provides sealing engagement between ported sub 32 and lug window sub 36, as seen in FIG. 1C.

Lower housing 18 is disposed below upper housing 16. At the upper end of lower housing 18 is a lug housing 42 disposed adjacent to lug window sub 36 and shearably connected thereto as will be further described herein.

The lower end of lug housing 42 is connected to a center mandrel 44 at threaded connection 46. See FIGS. 1C and 1D. A sealing means, such as an O-ring 48, provides sealing engagement therebetween. A tool connector 50 is disposed over the lower end of center mandrel 44, and sealing engagement is provided therebetween by a sealing means, such as a pair of O-rings 52.

Figure 1D:
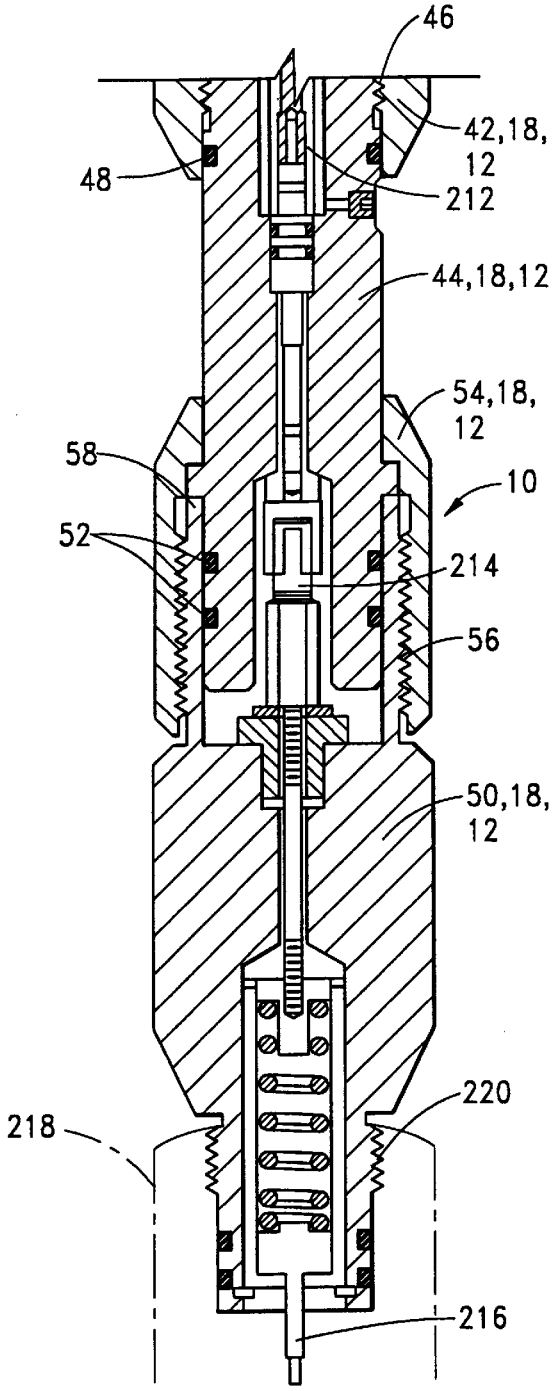

Also as seen in FIG. 1D, a quick-connect collar 54 is attached to tool connector 50 at threaded connection 56. Collar 54 is of a kind known in the art and it will be seen that it connects tool connector 50 to center mandrel 44 by clamping against an outwardly extending flange 58 on the center mandrel.

Referring again to FIG. 1A, top adapter 20 has an internal thread 60 adapted for connection to a length of coiled tubing 62 of a kind known in the art. A logging cable 64 is run through the length of coiled tubing 62 and into the upper portion of upper housing 16.

Disposed in collar 22 between top adapter 20 and piston sub 26 is a body 66 which generally defines a first longitudinal passageway 68 and a second longitudinal passageway 70 which is substantially parallel to the first passageway. Disposed in an enlarged portion of first longitudinal passageway 68 are a pair of check valves 72. A sealing means, such as an O-ring 74, provides sealing engagement between each check valve 72 and body 66. Check valves 72 are of a kind known in the art such as ball-type or flapper-type check valves and allow fluid flow downwardly through first longitudinal passageway 68 while preventing upward fluid flow therethrough. Two such check valves 72 are used for redundancy in the event of failure of one of them. Such redundancy is required in some well operations, such as offshore operations in the North Sea.

The lower end of logging cable 64 extends into second longitudinal passageway 70 in body 66, and the logging cable is attached to the body by a cable clamp 76. Cable clamp 76 is of a kind known in the art and clampingly engages the outside of logging cable 64. Cable clamp 76 is attached to body 66 at threaded connection 78.

A bulkhead 80 is disposed in an enlarged lower portion of second longitudinal passageway 70, and as seen in FIGS. 1A and 1B, a sealing means, such as a pair of O-rings 82, provides sealing engagement between bulkhead 80 and body 66. Bulkhead 80 is adjacent to the top of piston sub 26.

Upper and lower halves 84 and 86 of an electrical feed-through 88, of a kind known in the art, are attached to bulkhead 80 and extend therefrom on opposite upper and lower sides, respectively, of the bulkhead. A wire 90 extends down from logging cable 64 and terminates at electrical feed-through 88. Another wire 91 extends downwardly from electrical feed-through 88. Feed-through 88 provides an electrical connection between wires 90 and 91.

Still referring to FIG. 1B, piston sub 26 defines a first longitudinal passageway 92 therein which is generally aligned and in communication with first longitudinal passageway 68 in body 66. Piston sub 26 also defines a second longitudinal passageway 94 therethrough which is substantially parallel to first longitudinal passageway 92 and is substantially aligned with second longitudinal passageway 70 in body 66. It will be seen that lower half 86 of electrical feed-through 88 extends into second longitudinal passageway 94 in piston sub 26.

Below first longitudinal passageway 92 and second longitudinal passageway 94, upper housing 16 defines a centrally located, longitudinally extending piston cavity 96 therein which is in communication with first longitudinal passageway 92 and second longitudinal passageway 94 in piston sub 26. Piston cavity 96 is formed by a first bore 98 in the lower end of piston sub 26, a second bore 100 in ported sub 32, a third bore 102 in the ported sub and a fourth bore 104 in lug window sub 36, as seen in FIGS. 1B and 1C. First bore 98 is the largest, second bore 100 is somewhat smaller than first bore 98, and third bore 102 is smaller than second bore 100. Fourth bore 104 is substantially the same size as third bore 102. An upwardly facing shoulder 106 in ported sub 32 extends between first bore 98 and second bore 100, and an angled ramp or chamfer 108 in the ported sub extends between second bore 100 and third bore 102.

Actuating piston 14 is disposed in piston cavity 98 and is movable longitudinally therein. Still referring to FIGS. 1B and 1C, piston 14 comprises an upper piston 110 and a lug prop 112 attached to the upper piston at threaded connection 114.

Referring to FIG. 1B, piston 14 has a first outside diameter 116 and a smaller second outside diameter 118 on upper piston 110. An annular, downwardly facing shoulder 120 extends between first outside diameter 116 and second outside diameter 118. A first seal 122 disposed in first outside diameter 116 provides sealing engagement between piston 14 and first bore 98. Below first seal 122, a second seal 124 is carried on piston 14 in second outside diameter 118, and a third seal 126 is carried on piston 14 in second outside diameter 118 below second seal 124. Third seal 126 provides sealing engagement between piston 14 and third bore 102. The operation of second seal 124 will be further described herein.

Below third seal 126, upper piston 110 of piston 14 forms an annular recess 128 which may also be referred to as a lug saddle 128. Lug saddle 128 will thus be seen to be generally annular with chamfers 129 at the upper and lower ends thereof.

Piston 14 also has a third outside diameter 130 on lug prop 112. Third outside diameter 130 on lug prop 112 is substantially the same size as second outside diameter 118 on upper piston 110. Below third outside diameter 130, piston 14 has a fourth outside diameter 132 on lug prop 112. A downwardly facing shoulder 133 extends between third outside diameter 130 and fourth outside diameter 132.

Upper piston 110 of piston 14 defines a bore 134 therein with a large upwardly facing chamfer 136 at the upper end thereof. Chamfer 136 insures that bore 134 is in communication with first longitudinal passageway 92 and second longitudinal passageway 94 in piston sub 26 of upper housing 16.

A plurality of replaceable and interchangeable nozzles 138 are disposed in corresponding piston flow ports 139 and are attached by threaded connections 140. Each nozzle 138 has a nozzle port or orifice 142 defined therein which extends transversely with respect to piston 14 and will be seen to be in communication with bore 134 in upper piston 110. The size of nozzle ports 142 may be varied so that the flow through nozzles 138 may be changed as desired. The use of nozzles 138 and the selection of nozzle ports 142 will be more fully described herein.

Below nozzles 138, upper piston 110 defines a transversely extending equalizing port 144 therein which provides communication between bore 134 and the outside of piston 14 below third seal 126. Thus, it will be seen that pressure above and below piston 14 is substantially equalized.

Upper piston 110 also defines a longitudinally extending hole 146 which is spaced off center from bore 134 and extends the length of the upper piston. Hole 146 does not intersect any of piston ports 139 and is not in communication with them. Hole 146 is in communication with a bore 148 and a hole 150 both defined in lug prop 112. Referring again to FIGS. 1B and 1C, wire 90 extends down from lower half 86 of electrical feed-through 88 and through second longitudinal passageway 94 in piston sub 26, hole 146 in upper piston 110, bore 148 and hole 150 in lug prop 112 and thus downwardly into lower housing 18.

Referring again to FIG. 1B, ported sub 32 of upper housing 16 defines a plurality of housing flow ports 152 transversely therethrough. Flow ports 152 will be seen to be in communication with nozzles 138 through an annulus 154 defined between second bore 100 in ported sub 32 and second outside diameter 118 on upper piston 110.

Above flow ports 152, ported sub 32 also defines a plurality of transversely extending vent ports 156 therein. Vent ports 156 are substantially longitudinally aligned with a similar set of vent ports 158 defined in piston sub 26. Communication is provided between vent ports 156 and 158 through an annulus 160 defined between piston sub 26 and ported sub 32 below threaded connection 34 and above shoulder 106. Vent ports 156 and 158 will also be seen to be in communication with an annulus 162 defined between first bore 98 in piston sub 26 and second outside diameter 118 on upper piston 110 below shoulder 120.

Referring again to FIG. 1C, upper housing 16 and lower housing 18 of outer housing 12 are connected together by a first, housing shearing means, such as a plurality of shear pins 164. Each shear pin 164 is disposed through a hole 166 extending transversely in lug housing 42, and the shear pins extend into a corresponding plurality of radially oriented holes 168 defined in the lower end of lug window sub 36. A sealing means, such as an O-ring 170, provides sealing engagement between lug window sub 36 and lug housing 32 and thus between upper housing 16 and lower housing 18.

Below shear pins 164 and O-ring 170, lug housing 42 defines an annular lug recess 172 having a chamfer 174 at the upper end thereof. Lug window sub 36 defines a plurality of radially extending lug windows 176 therein which generally face lug recess 172 in lug housing 42. A lug 178 is disposed in each of lug windows 176. Each lug 178 has a locked position in which an inner surface 180 engages third outside diameter 130 on lug prop 112 of piston 14 when the piston is in the running position thereof shown in FIGS. 1B–1C. Each lug 178 also has an outer surface 182 which extends into lug recess 172 in lug housing 42 when the lugs are in the locked position. Further, each lug 79 has an outwardly and upwardly facing chamfer 184 thereon which generally faces chamfer 174 in lug recess 172. As will be further described, lugs provide a locking means for preventing relative longitudinal movement of upper and lower housings 16 and 18, thereby preventing premature shearing of shear pins 164.

The lower end of lug window sub 36 is attached to a spring rest collar 186 at threaded connection 188. Both the lower end of lug window sub 36 and spring rest collar 186 extend into a bore 190 defined in lug housing 42. Spring rest collar 186 defines a bore 192 therein which is substantially the same size as fourth bore 104 defined in lug window sub 36. At the lower end of bore 192 is an inwardly extending shoulder 194.

A spring rest 196 is disposed in the upper end of bore 192 in spring rest collar 186. Spring rest 196 is attached to spring rest collar 186 by a second, spring rest shearing means, such as a plurality of shear pins 198. Each shear pin 198 is positioned in a hole 200 defined transversely in spring rest collar 186, and the shear pins extend into an annular groove 202 in the outside of spring rest 196.

A biasing means, such as a compression spring 204, is disposed between an upper end 206 of spring rest 196 and shoulder 133 on lug prop 112 of piston 14. It will thus be seen that piston 14 is biased upwardly to the running position shown in FIGS. 1B and 1C.

Wire 91 extends downwardly through a hole 208 in the center of spring rest 196 and another hole 210 in the lower end of spring rest collar 186 so that the wire terminates at an electric feed-through 212 positioned in center mandrel 44 of lower housing 18. Electric feed-through 212 is in electrical communication with a spring contact 214 which in turn is in electrical contact with a wireline tool connector 216. Cablehead 10 is used to run a known wireline tool 218, such as a logging tool and/or set of perforating guns. Wireline tool 218 is attached to a logging tool/gun connection in the form of threaded surface 220 on tool connector 50 of lower housing 18. This connection is, both mechanically and electrically, of a kind known in the art in which the tool string itself is the ground.

Operation of the Invention

Referring still to FIGS. 1A–1D, cablehead 10 is attached at threaded surface 60 in top adapter 20 to a coiled tubing connector so that the cablehead is at the end of a string of coiled tubing 62. Piston 14 is in the running position and lugs 178 are in their locked position. Wireline tool 218 is attached to threaded surface 220 at the bottom of tool connector 50. As mentioned above, this wireline tool may be one of any number of known tools, such as a logging tool and/or a set of perforating guns. The entire tool string is run into a well in a manner known in the art. If wireline tool 218 includes a logging tool, the logging operation may be carried out in a known manner. If wireline tool 218 includes perforating guns, the guns may be positioned and triggered to carry out the desired perforating operation. In perforating, shock loading may be transmitted upwardly into cablehead 10 as previously discussed herein. All such shock loading will be absorbed by the locked interconnection of upper housing 16 and lower housing 18 by lugs 178. That is, no shock loading can be transmitted to shear pins 164 when lugs 178 are in the locked position shown in FIG. 1C. Therefore, premature shearing of shear pins 164 and separation of upper housing 16 from upper housing 18 are prevented.

If wireline tool 218 does not become stuck in the well, coiled tubing 62, cablehead 10 and the wireline tool may be retrieved from the well in a normal manner. However, if wireline tool 218 becomes stuck in the hole, then the cablehead 10 may be operated to release the wireline tool from coiled tubing 62 so that coiled tubing and upper housing 16 may be retrieved from the well. Lower housing 18 and wireline tool 218 are then left in the well and subsequently fished on a separate trip.

Prior to actuation of cablehead 10, the components therein are in the positions shown in FIGS. 1A–1D as already mentioned. Piston 14 is at its uppermost, running position within housing 12. Lugs 178 are in the locked position in which relative longitudinal movement between upper housing 16 and lower housing 18 is prevented, and thus shearing of shear pins 164 is also prevented.

When it is desired to release wireline tool 18, fluid is pumped down coiled tubing 62 which causes flow through a first flow path 222. Still referring to FIGS. 1A–1D, first flow path 222 is formed by first longitudinal passageway 68 in body 66, check valves 72, first longitudinal passageway 92 in piston sub 26, bore 134 in upper piston 110, piston flow ports 139, nozzle ports 142 in nozzles 138, annulus 154 and housing flow ports 152 in ported sub 32 and out into an annulus (not shown) defined between the tool and the wellbore. Until flow reaches a predetermined level, piston 14 is held in the running position shown in FIGS. 1B and 1C by spring 204.

As the flow rate of fluid pumped down coiled tubing 62 is increased, the pressure in cablehead 10 also increases. Once this pressure reaches a predetermined value, the force acting downwardly on piston 14 as a result of the differential area between first seal 122 and third seal 126 will cause the piston to stroke downwardly until the lower end thereof engages spring rest 196 as seen in FIGS. 2A–2D.

Figure 2A:
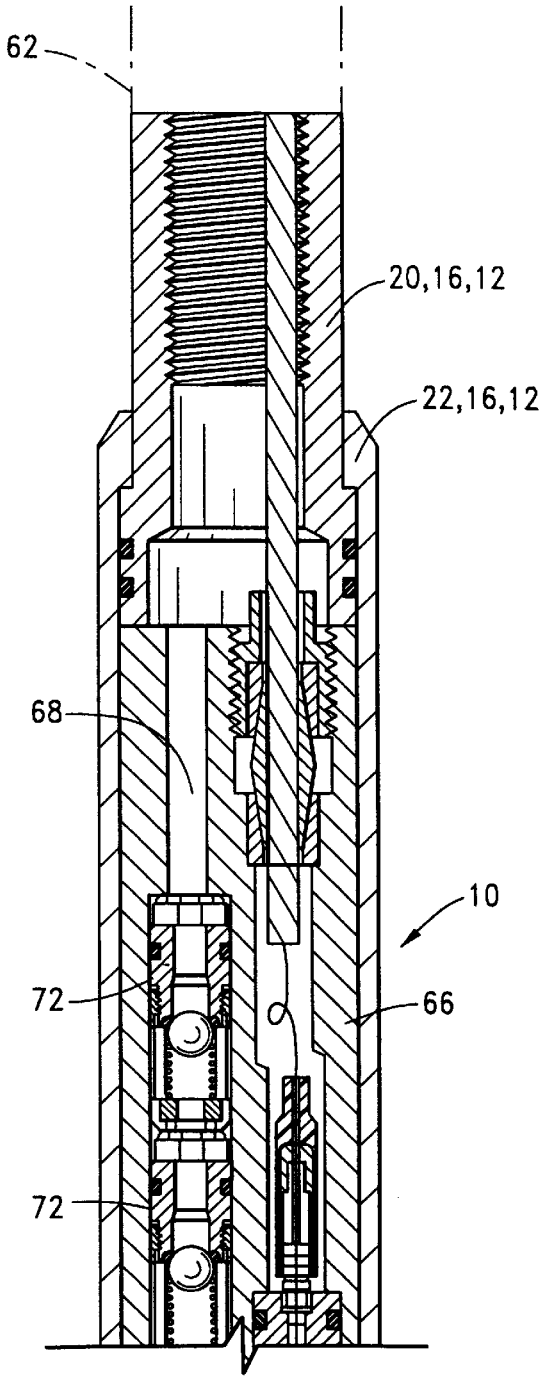
FIGS. 2A–2D show the cablehead with the actuating piston in a sealing position and the lugs still in the locked position.
Figure 2B:
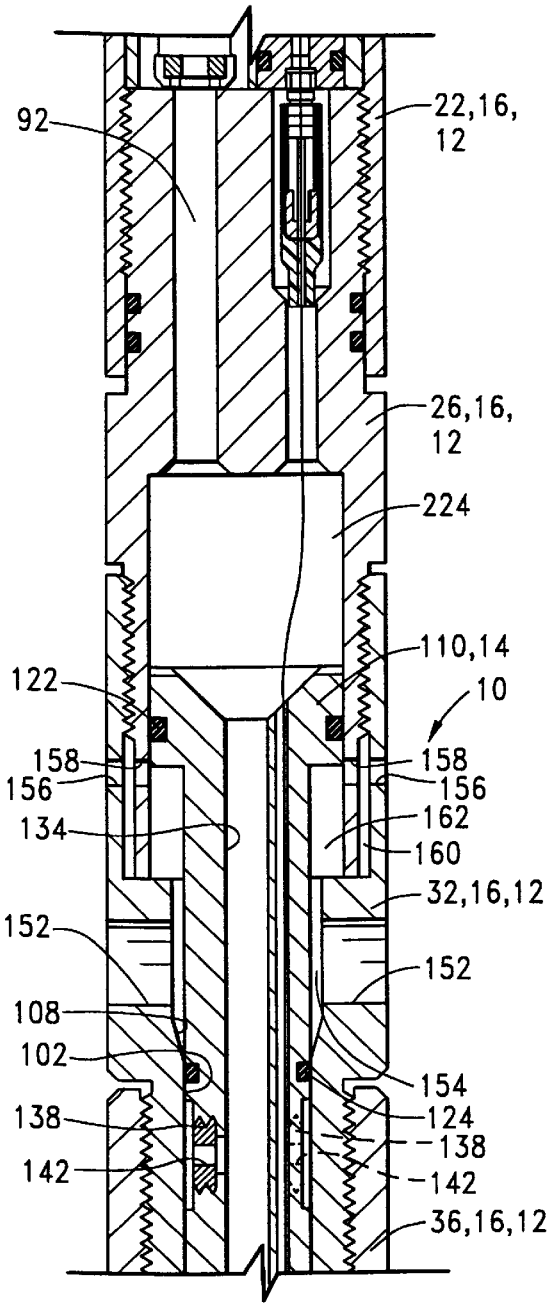

As piston 14 is moved to this second position, seal 124 will be moved into engagement with ramp 108 and then gradually brought into sealing engagement with third bore 102 in ported sub 32 as seen in FIG. 2B. Nozzle ports 142 in nozzles 138 are thus sealingly separated by second seal 124 from housing flow ports 152. Flow ports 152, vent ports 156 and vent ports 158 are also sealingly separated from cavity 224 above piston 14 by first seal 122. Thus, this position of piston 14 may be referred to as a sealed position.

Figure 2C:
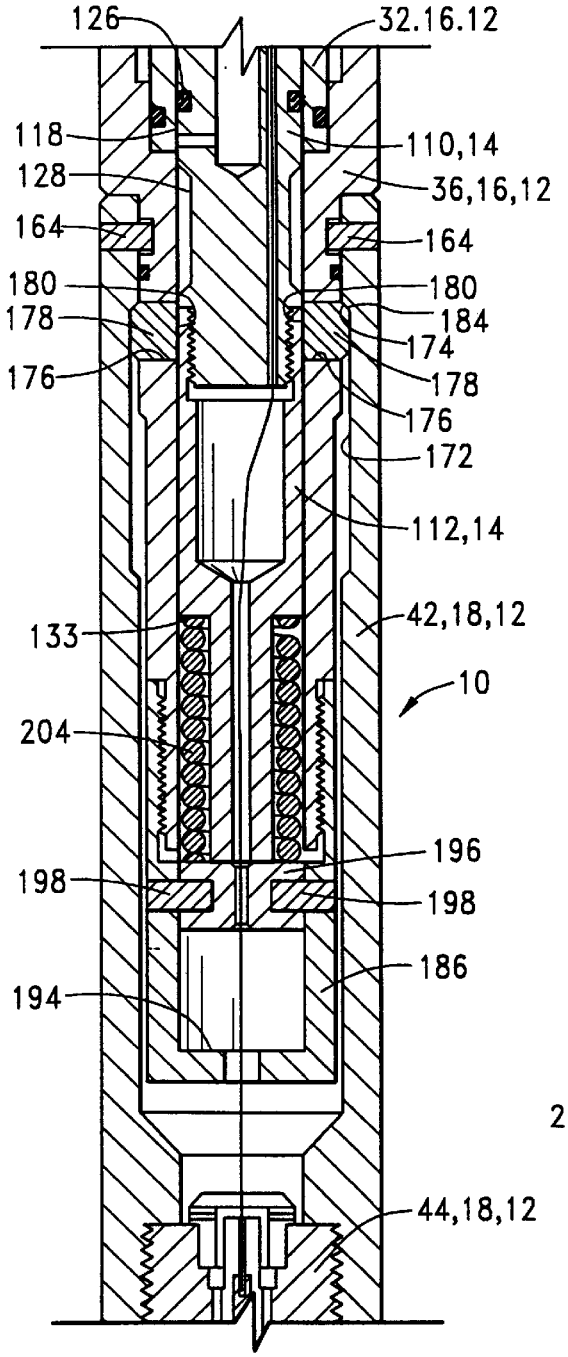
Figure 2D:
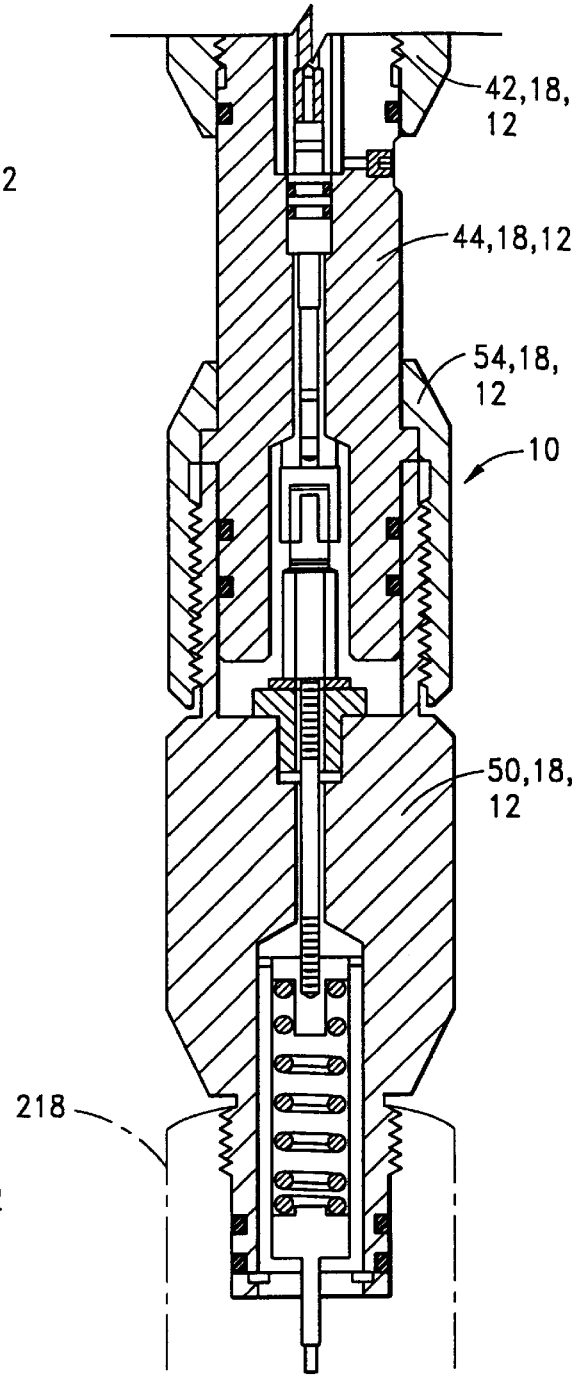
Figure 3A:
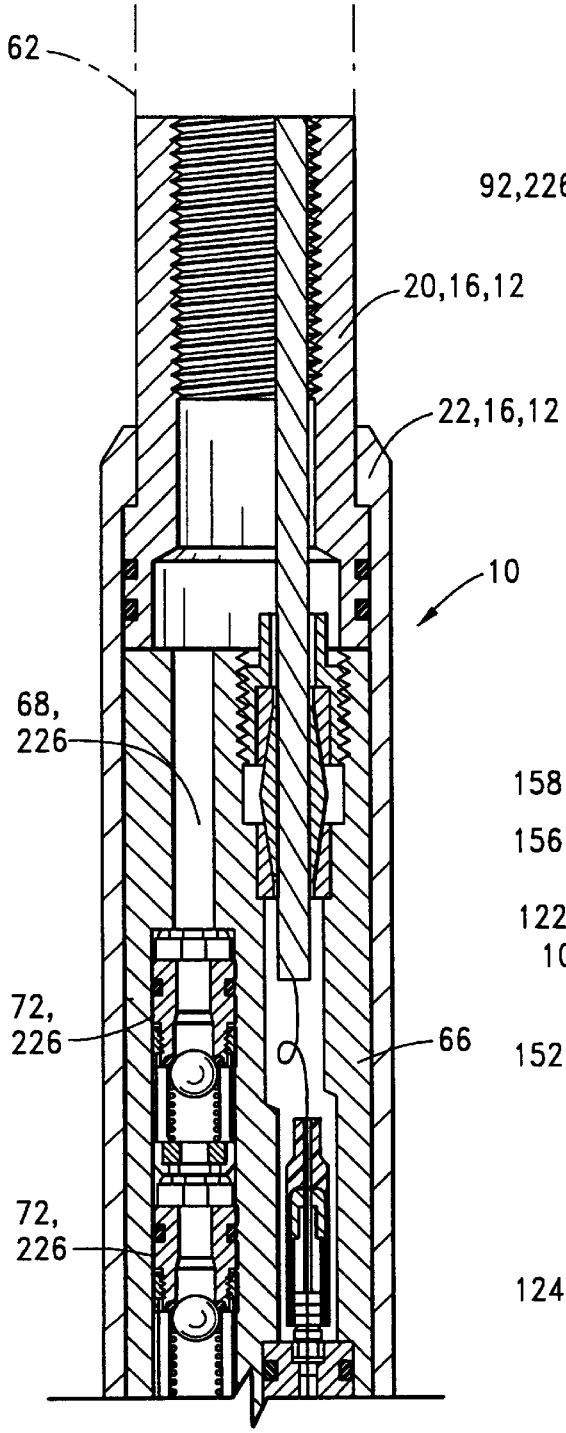
FIGS. 3A–3D illustrate the cablehead with the actuating piston in a releasing position so that the lugs may be moved to the unlocked position.
Figure 3B:
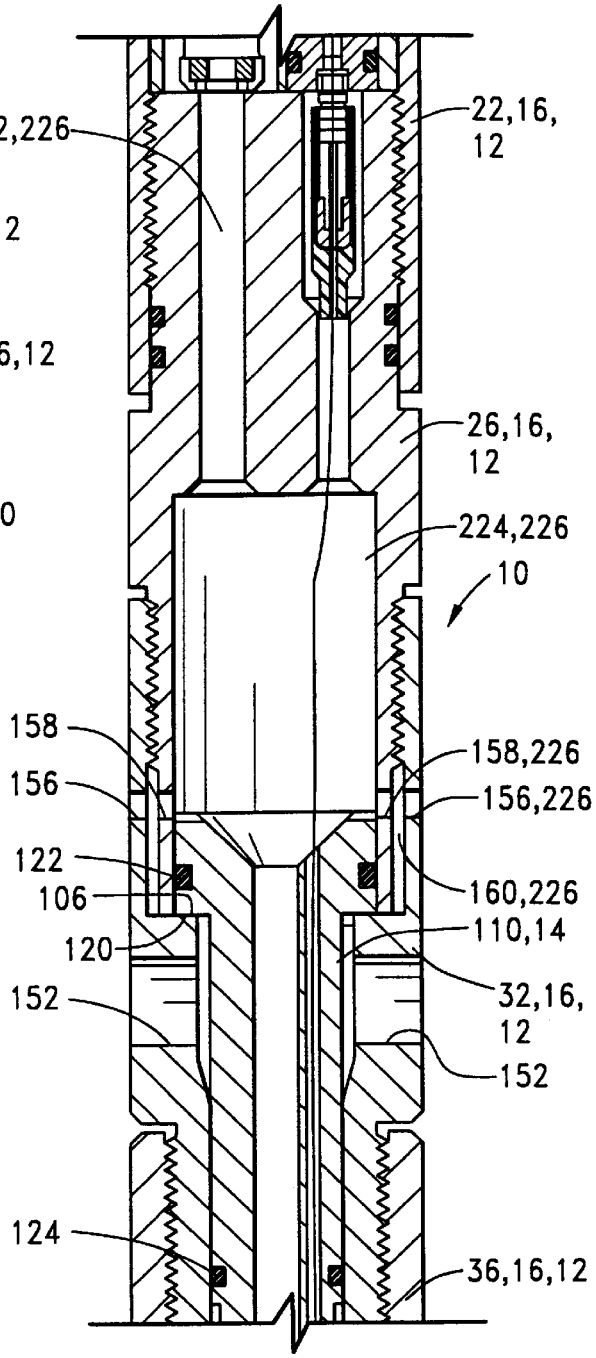
Figure 3C:
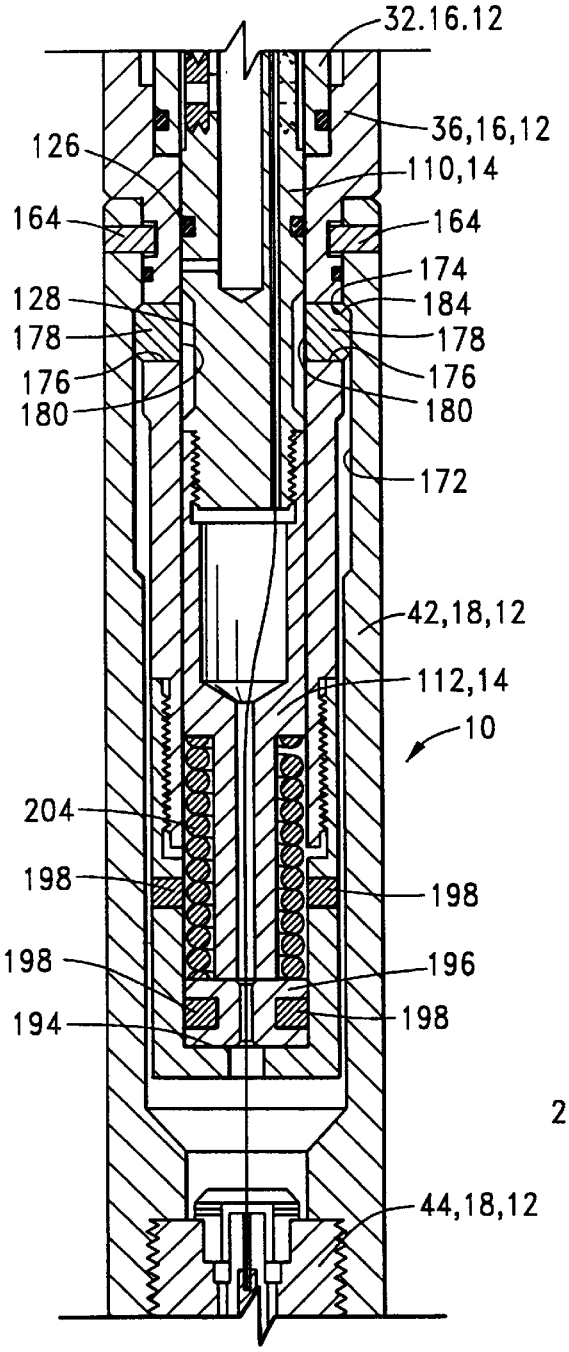
Figure 3D:
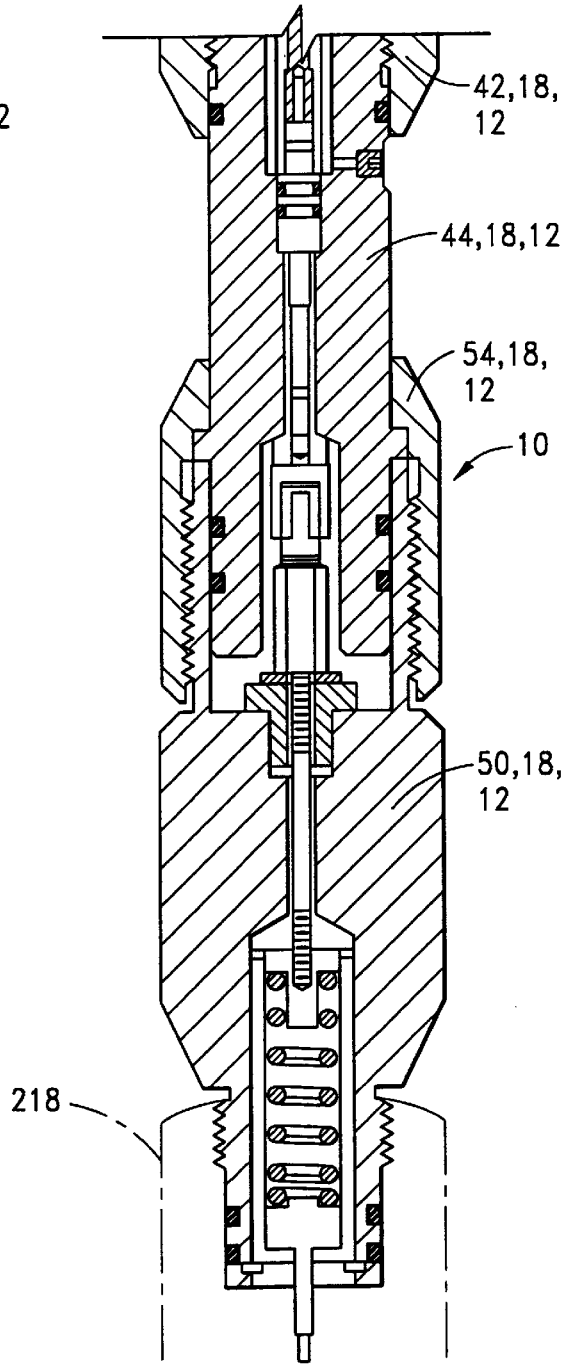

The amount of pressure necessary to move piston 14 from the running position of FIGS. 1B and 1C to the sealed position of FIGS. 2B and 2C is determined by the spring rate of spring 204. The flow rate necessary to achieve this pressure is a function of the size of orifices or ports 142 in nozzles 138. The size of orifices 142 in nozzles 138 can be varied, and the nozzles are easily interchangeable because they are threadingly engaged with piston 14. In making up cablehead 10, the operator can determine what the sizes of orifices 142 should be for the particular well conditions that are expected. The operator can then pump fluid down coiled tubing 62 as previously described to move piston 14 from the running position to the sealed position. When piston 14 is moved to the sealed position and into contact with spring rest 196, the operator will receive a positive indication at the surface that this has occurred, thus indicating that cablehead 10 is working properly to that point.

Once piston 14 is in the sealed position, there is no longer flow down through coiled tubing 62 or cablehead 10 because all of the ports are sealed. Thus increased pumping at the surface will simply raise the pressure in the cablehead. This pressure is thus increased to the point necessary to shear shear pins 198, thereby allowing further downward movement of piston 14, along with spring 204 and spring rest 196 until the spring rest contacts shoulder 194 in spring rest collar 186. This is illustrated in FIGS. 3A–3D. In this position of piston 14, lug saddle 128 is brought into alignment with lugs 178 so that they are free to be moved radially inwardly to an unlocked position as will be further described herein. Thus, this position of piston 14 may be referred to as a releasing position.

In the releasing position of piston 14, shoulder 120 on upper piston 110 is brought into engagement with shoulder 106 on ported sub 32. It will be seen that housing flow ports 152 and orifices 142 are still closed. However, because the top of upper piston 110 of piston 14 is moved substantially below vent ports 156 and 158, these vent ports are now opened. That is, a second flow path 226 is defined through cablehead 10. This second flow path 226 includes first longitudinal passageway 68 in body 66, check valves 72, second longitudinal passageway 92 in piston sub 26, cavity 224, vent ports 158 in piston sub 26, annulus 160 and vent ports 156 in ported sub 32. Thus, circulation is regained through cablehead 10 so that fluid may again be pumped down coiled tubing 62 and out vent ports 158 and 156 into the well annulus. When circulation is then regained, the operator receives an indication of this at the surface so that it is known that the cablehead has been properly actuated, and that coiled tubing 62 and upper housing 16 and the components therein are ready to be retrieved from the well.

When in the releasing position of FIGS. 3A–3D, tension may be applied to coiled tubing 62. Because wireline tool 218 is stuck, the tension on the coiled tubing will result in the substantially simultaneous shearing of shear pins 164 and the engagement of chamfers 184 on lugs 178 with chamfer 174 at the top of lug recess 172 in lug housing 42. This chamfered engagement will force lugs 178 to be moved radially inwardly to their unlocked position in which inner surfaces 180 thereof are directed toward lug saddle 128.

Figure 4A:
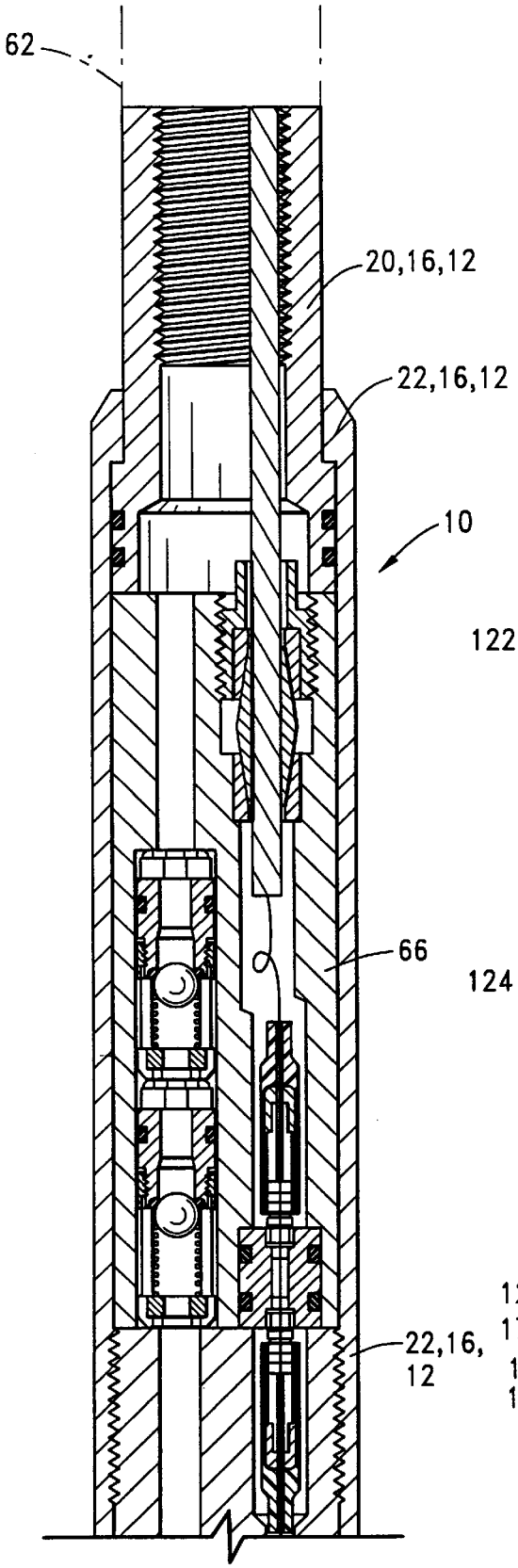
FIGS. 4A–4D illustrate the cablehead after tension has been applied to the tubing string to separate upper and lower housings in the event of a stuck tool.
Figure 4B:
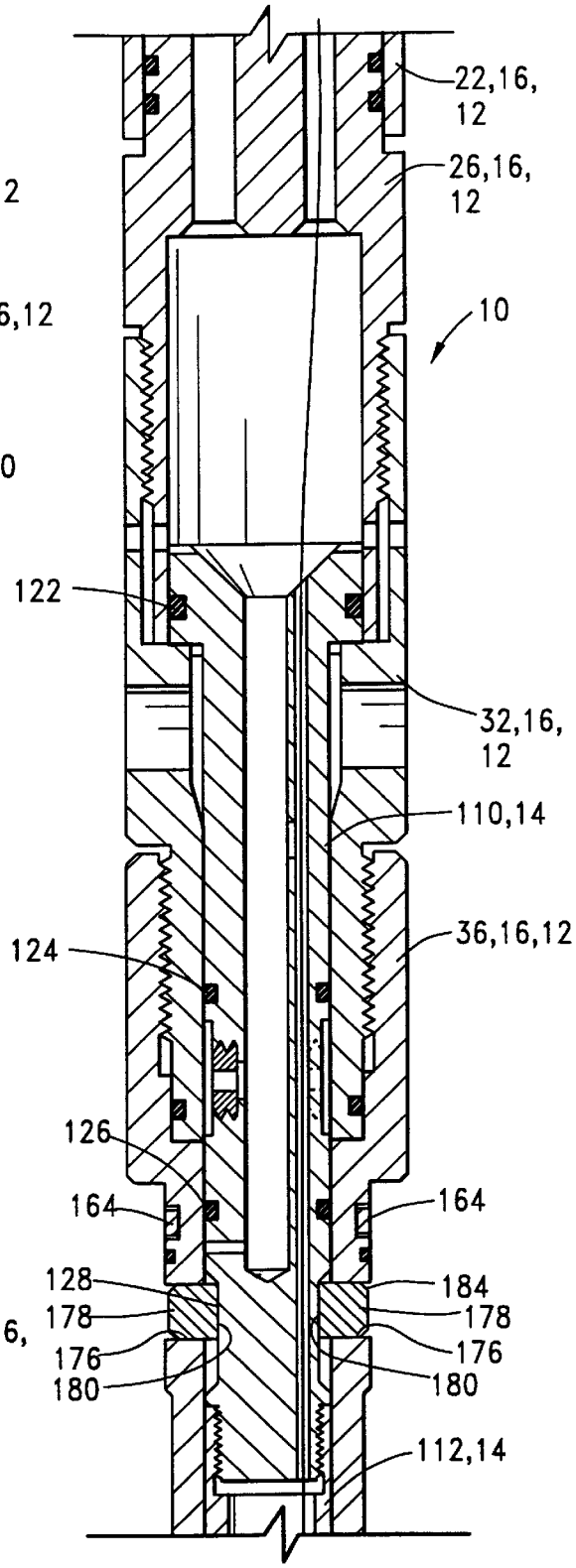
Figure 4C:
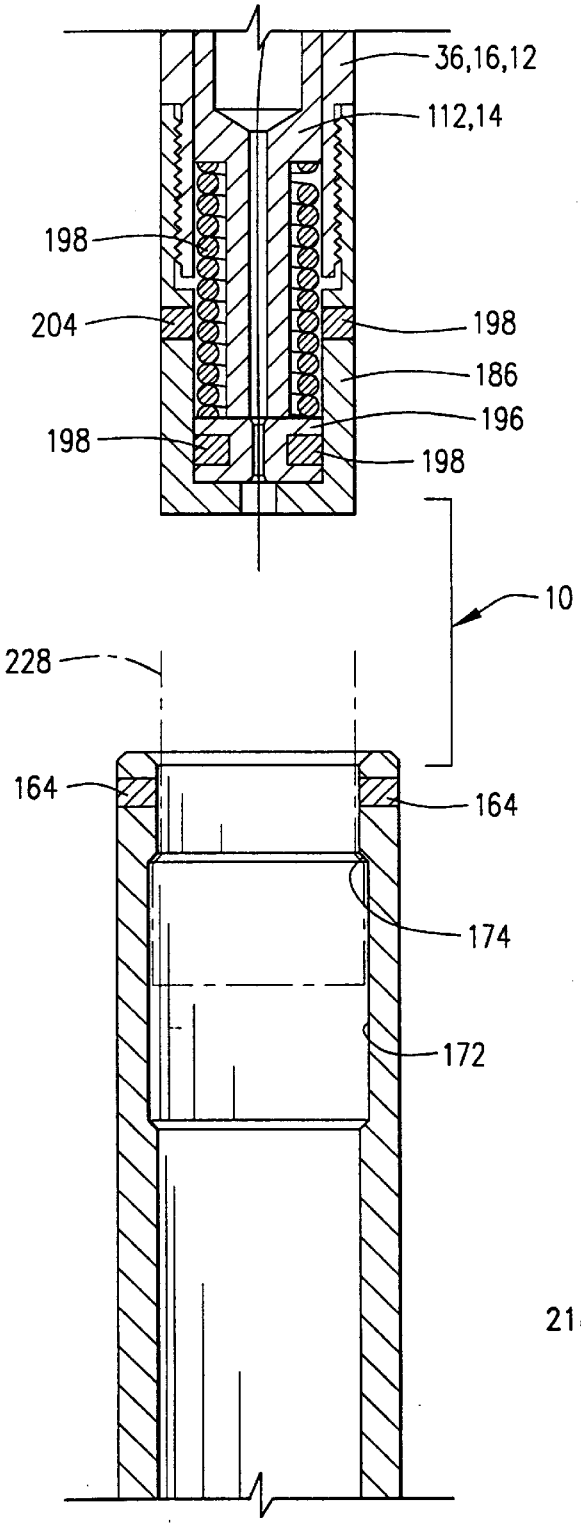
Figure 4D:
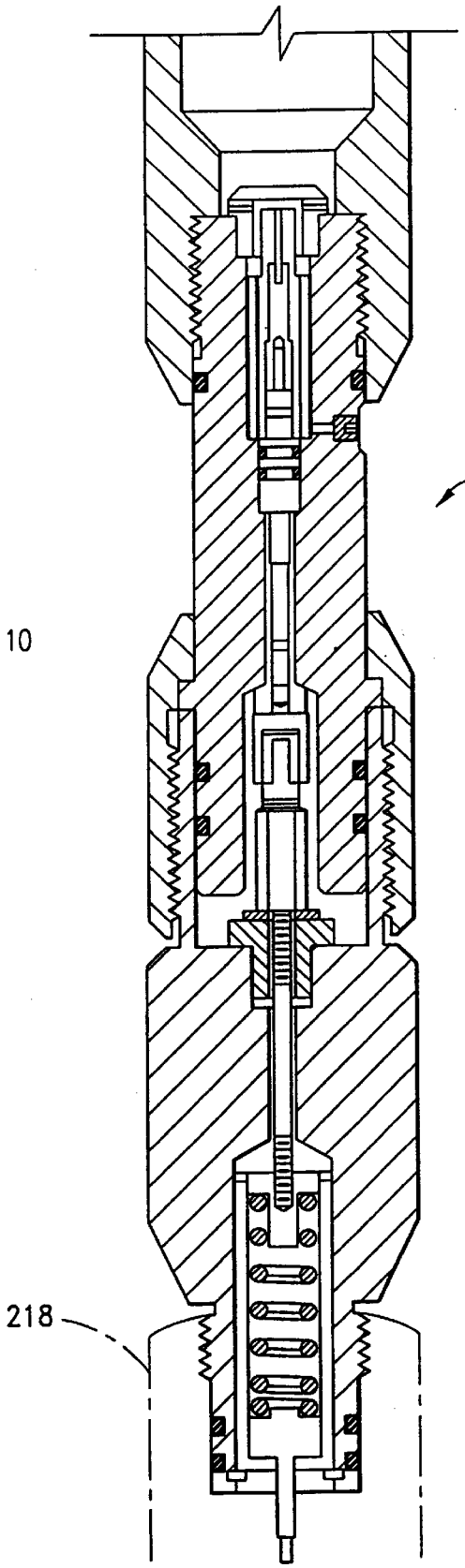

Referring now to FIGS. 4A–4D, cablehead 10 is shown with upper housing 16 completely detached from lower housing 18. Shear pins 164 are completely sheared, and lugs 178 are shown to be moved fully radially inwardly. That is, during the application of tension, lugs 178 are moved from their locked position to their unlocked position wherein inner surfaces 180 of the lugs engage lug saddle 128 so that the lugs are completely retracted within lug windows 176 and no longer prevent relative longitudinal movement between upper housing 16 and lower housing 18. Once upper housing 16 and lower housing 18 are thus separated, coiled tubing 62 and upper housing 16, along with the components within the upper housing, may be removed from the well. Wireline tool 218 with lower housing 18 attached thereto remains in the wellbore. Referring to FIG. 4C, lug recess 172 and chamfer 174 at the upper end thereof now provide an internal fishing neck in lower housing 18 which may be later engaged by a GS pulling/fitting tool 228 of a kind known in the art.

In summary, three conditions must exist before cablehead 10 can be completely actuated and upper housing 16 and lower housing 18 separated. First, a sufficient flow rate must be established to shift piston 14 from the running position to the sealed position thereof. Second, additional pressure must be applied to shear shear pins 198 to move piston 14 to its releasing position. Third, tension must be applied to coiled tubing 16 to shear shear pins 164 which connect upper housing 16 and lower housing 18. By requiring these three conditions, a high degree of confidence is maintained that cablehead 10 will not be prematurely released or actuated.

The invention is not intended to be limited to the illustrated embodiment. For example, the drawings show only a single conductor cable. A multi-connector cable could also be utilized by providing additional holes for the wires to run and utilizing multiple electrical connectors. Also, the logging tool connection at the bottom of cablehead 10 can be easily changed to adapt any brand of logging tool.

It will be seen, therefore, that the heavy-duty logging and perforating cablehead for coiled tubing of the present invention is well adapted to carry out the ends and advantages mentioned as well as those inherent therein. While a presently preferred embodiment of the invention has been shown for the purposes of this disclosure, numerous changes in the arrangement and construction of parts may be made by those skilled in the art. All such changes are encompassed within the scope of the appended claims.

What is claimed is:

1. A cablehead for use with coiled tubing electric line in well operations, said cablehead comprising:

a housing comprising:

an upper housing adapted for connection to a length of coiled tubing;

a lower housing adjacent to said upper housing; and a shearing means for shearably attaching said lower housing to said upper housing, said shearing means being shearable in response to relative movement between said upper housing and said lower housing such that said upper housing and said lower housing are separated when tension is applied to the coiled tubing;

locking means, disposed between said upper and lower housings, for preventing said relative movement and thereby preventing shearing of said shearing means when said locking means is in a locked position and allowing shearing of such shearing means when said locking means is in an unlocked position by said relative movement; and a piston slidably disposed in said housing, said piston having a running position holding said locking means in said locked position and being movable to a releasing position allowing movement of said locking means to said unlocked position.

2. The cablehead of claim 1 wherein said piston has a saddle thereon which is aligned with said locking means when said piston is in said releasing position thereof.

3. The cablehead of claim 1 further comprising biasing means in said housing for biasing said piston toward said running position thereof.

4. The cablehead of claim 3 wherein said biasing means is characterized by a compression spring.

5. The apparatus of claim 1 wherein said housing and said piston define a flow path therein for circulation of fluid therethrough when said piston is in said running position.

6. The apparatus of claim 5 further comprising a nozzle disposed across said flow path for controlling a fluid flow rate therethrough.

7. The apparatus of claim 6 wherein said nozzle is one of a plurality of interchangeable nozzles.

8. The apparatus of claim 5 wherein said flow path is closed when said piston is in said releasing position thereof.

9. The apparatus of claim 8 wherein said housing defines a second flow path for allowing circulation of fluid therethrough when said piston is in said releasing position.

10. The apparatus of claim 1 wherein said piston comprises:

an upper piston on which said saddle is located; and a prop attached to said upper piston.

11. The apparatus of claim 1 wherein:

said lower housing defines a recess therein;

said upper housing defines a lug window therein aligned with said recess; and said locking means is characterized by a lug disposed in said window and extending into said recess when in said locked position and spaced from said recess when in said unlocked position.

12. The apparatus of claim 11 wherein:

said piston has a recessed saddle thereon; and said lug extends into said saddle when in said unlocked position.

13. A cablehead for use in well operations on a coiled tubing electric line, said cablehead comprising:

a housing comprising:

an upper housing adapted for connection to a length of coiled tubing;

a lower housing adjacent to said upper housing and adapted for connection to a wireline tool; and a housing shearing means for shearably attaching said lower housing to said upper housing;

a lug disposed in said housing, said lug having a locked position engaging said upper and lower housings, said locked position preventing relative longitudinal movement therebetween and thereby preventing shearing of said housing shearing means, and an unlocked position disengaged from one of said upper and lower housings, said unlocked position allowing relative longitudinal movement between said upper and lower housings thereby allowing shearing of said housing shearing means;

a spring rest disposed in said housing;

a spring rest shearing means for shearably attaching said spring rest to said housing;

a piston slidably disposed in said housing and movable between a running position in which said lug is held in said locked position, a sealing position in which said lug is held in said locked position, and a releasing position in which said lug is released from said locked position and free to move to said unlocked position, said housing and piston defining a first flow path therethrough when said piston is in said running position and said housing defining a second flow path therethrough when said piston is in said releasing position, said first and second flow paths being closed when said piston is in said sealed position; and a spring disposed between said spring rest and said piston, said spring biasing said piston toward said running position;

wherein:

when fluid is pumped down the coiled tubing and through the first flow path when said piston is in said running position, a first operating indication is provided to an operator;

when the fluid flow is increased, a differential pressure is created across said piston to compress said spring and move said piston to said sealing position, closing said first flow path and providing a second operating indication to the operator;

when additional pressure is applied in said housing to shear said spring rest shearing means, said piston is moved to said releasing position, opening said second flow path and providing a third operating indication to the operator; and when said piston is in said releasing position and tension is applied to the coiled tubing said lug is moved to said unlocked position and said housing shearing means is sheared.

14. The cablehead of claim 13 further comprising a nozzle disposed in said first flow path.

15. The cablehead of claim 14 wherein said nozzle is one of a plurality of interchangeable nozzles connectable to said piston.

16. The cablehead of claim 13 wherein said first flow path comprises:

a housing longitudinal opening and a transverse housing flow port defined in said housing; and a piston longitudinal opening and a transverse piston flow port defined in said piston.

17. The cablehead of claim 16 further comprising a replaceable nozzle disposed in said piston flow port.

18. The cablehead of claim 16 further comprising a check valve disposed in said housing longitudinal opening for allowing fluid flow downwardly therethrough and preventing fluid flow upwardly therethrough.

19. The cablehead of claim 13 wherein said second flow path comprises a housing longitudinal opening and a transverse housing vent port defined in said housing.

20. The cablehead of claim 13 wherein said spring rest shearing means shearably attaches said spring rest to said upper housing.

21. The cablehead of claim 20 wherein said upper housing has a shoulder for limiting movement of said spring rest.

22. The cablehead of claim 13 wherein said piston comprises a saddle thereon for receiving said lug when said piston is in said releasing position.

23. The cablehead of claim 13 wherein said lug is one of a plurality of lugs spaced around said housing.

24. The cablehead of claim 13 wherein:

said lower housing defines a recess therein;

said upper housing defines a lug window therein aligned with said recess; and said lug is disposed in said window and extends into said recess when in said locked position and is retracted from said recess when in said unlocked position.

25. The cablehead of claim 13 further comprising a back check valve disposed in said first flow path.

26. The cablehead of claim 25 wherein said check valve is one of a plurality of ball check valves.

27. A method of releasing a wireline tool in a well comprising the steps of:

(a) providing a cablehead for connecting the wireline tool to a length of coiled tubing, said cablehead comprising:

a housing having an upper housing connectable to the coiled tubing and a lower housing shearably attached to the upper housing with a shear pin and connectable to the wireline tool, said upper and lower housings being shearably detachable from one another when tension is applied to the coiled tubing;

a lug disposed in the housing for preventing shearing disconnection of the upper and lower housings when the lug is in a locked position and allowing shearing disconnection between the upper and lower housings when the lug is in an unlocked position; and a piston disposed in the housing and movable between a running position holding the lug in the locked position and a releasing position allowing the lug to be moved to the unlocked position;

(b) when said piston is in said rnning position, running the coiled tubing, cablehead and wireline tool into a wellbore;

(c) pumping fluid down the coiled tubing and applying pressure to said piston and thereby moving said piston to said releasing position;

(d) applying tension to the coiled tubing such that, substantially simultaneously, said lug is moved to said unlocked position and said upper housing is shearably disconnected from said lower housing as a result of said tension to break said shear pin; and (e) removing said coiled tubing and said upper housing from the wellbore.

28. The method of claim 27 further comprising the step of:

(f) fishing said lower housing and said wireline tool from the wellbore.

29. The method of claim 28 wherein step (f) comprises:

engaging a fishing tool with a fishing neck defined in said lower housing when said upper housing has been disconnected from said lower housing.

30. A cablehead for use with coiled tubing electric line in well operations, said cablehead comprising:

a housing comprising:

an upper housing adapted for connection to a length of coiled tubing;

a lower housing adjacent to said upper housing; and a shearing means for shearably attaching said lower housing to said upper housing;

locking means, disposed between said upper and lower housings, for preventing shearing of said shearing means when said locking means is in a locked position and allowing shearing of said shearing means when said locking means is in an unlocked position by relative movement between said upper and lower housings;

a piston slidably disposed in said housing, said piston having a running position holding said locking means in said locked position and being movable to a releasing position allowing movement of said locking means to said unlocked position;

a spring rest disposed in said housing;

a second shearing means for shearably attaching such spring rest to said housing, said second shearing means being sheared when said piston is moved to said releasing position thereof; and a spring engaged with said piston and said spring rest for biasing said piston toward said running position thereof.

31. A method of releasing a wireline tool in a well comprising the steps of:

(a) providing a cablehead for connecting the wireline tool to a length of coiled tubing, said cablehead comprising:

a housing having an upper housing connectable to the coiled tubing and a lower housing shearably attached to the upper housing and connectable to the wireline tool;

a lug disposed in the housing for preventing shearing disconnection of the upper and lower housings when the lug is in a locked position and allowing shearing disconnection between the upper and lower housings when the lug is in an unlocked position;

a piston disposed in the housing and movable between a running position holding the lug in the locked position and a releasing position allowing the lug to be moved to the unlocked position;

a spring rest shearably connected to said housing; and a spring disposed between said spring rest and said piston for biasing said piston toward said releasing position;

(b) with said piston in said running position, running the coiled tubing, cablehead and wireline tool into the wellbore;

(c) pumping fluid through the coiled tubing and cablehead to move the piston from said running position to a sealing position engaging said spring rest, and when said piston is in said sealing position, applying pressure thereto, and thereby shearably releasing said spring rest from said housing and moving said piston to said releasing position;

(d) applying tension to the coiled tubing such that, substantially simultaneously, said lug is moved to said unlocked position and said upper housing is shearably disconnected from said lower housing; and (e) removing said coiled tubing and said upper housing from the wellbore.

* * * * *